United States Patent [19]

Kinst

[11] Patent Number: 4,621,477

[45] Date of Patent: Nov. 11, 1986

[54] WALL PANEL SYSTEM

[76] Inventor: Dennis I. Kinst, 8845 Burlington, Brookfield, Ill. 60513

[21] Appl. No.: 756,292

[22] Filed: Jul. 18, 1985

[51] Int. Cl.[4] ..... E04C 2/54

[52] U.S. Cl. ..... 52/780

[58] Field of Search ..... 52/250, 301, 721, 726, 52/729, 780, 781, 228.1

[56] References Cited

U.S. PATENT DOCUMENTS

| | | | |
|---|---|---|---|
| 712,299 | 10/1902 | Howland-Sherman | 52/301 |
| 829,397 | 8/1906 | Gerber . | |
| 1,057,674 | 4/1913 | Sauber et al. | 52/780 |
| 1,661,128 | 2/1928 | Mankedick | 52/780 |
| 1,883,376 | 10/1932 | Hilpert et al. | 52/250 |
| 1,998,688 | 4/1935 | Robinson et al. . | |
| 2,936,051 | 5/1960 | Martin | 52/726 |
| 3,052,291 | 9/1962 | Fellers | 52/781 |
| 3,124,222 | 3/1964 | Mote . | |
| 3,350,824 | 11/1967 | Wiebusch . | |
| 3,381,483 | 5/1968 | Huthsing, Jr. . | |
| 3,591,993 | 7/1971 | Reeves . | |
| 3,729,164 | 4/1973 | Baar . | |
| 4,407,612 | 10/1983 | van Weele . | |

FOREIGN PATENT DOCUMENTS

| | | | |
|---|---|---|---|
| 179405 | 1/1954 | Austria | 52/780 |

*Primary Examiner*—James L. Ridgill, Jr.

*Attorney, Agent, or Firm*—Laydig, Voit & Mayer, Ltd.

[57] ABSTRACT

An assemblable temporary wall unit construction for industrial buildings wherein horizontally spaced vertical H-beam column members receive, a plurality of preformed stackable reinforced concrete panels positionable between and bridging the columns, the spacing between said columns being such that the panels can be inserted horizontally by positioning one end of the panel adjacent one of said beam columns, aligning the panel and shifting said panel horizontally to bridge the spaced column beams and wedge-like metal filler members being insertable between the panels and column beams for rigidly holding and confining the panels with respect to the column beams.

7 Claims, 6 Drawing Figures

WALL PANEL SYSTEM

BACKGROUND OF THE INVENTION

The present invention relates generally to partition wall unit constructions for industrial buildings. In particular, the invention relates to a new wall panel system which is intended to replace temporary walls of concrete block or stud and wallboard conventionally used to provide walls or partitions in building structures.

Where it has been desired to erect temporary walls or partitions in industrial type buildings, it has been the conventional practice to make such walls from concrete blocks mortared together or to set up a framework of metal studs covered by wallboard panels. Aside from the rising costs of such materials, those types of construction require highly skilled labor. It is also difficult to salvage the materials when the walls are to be taken down or moved. Oftentimes, it is less costly, quicker and simplier to break such walls apart and start all over with fresh materials.

Previous attempts have been made to provide alternatives employing specially devised components that can be fitted together or assembled on the site. A particularly relevant construction of that type is shown in Wiebusch U.S. Pat. No. 3,350,824 issued Nov. 7, 1967, now expired. In the Wiebusch patent, a wall unit construction was made up from spaced H-shaped and corner shaped concrete beams set up vertically with preformed filler pieces or panels that were snugly inserted from the top in a stacked arrangement between the beams to form the wall. Other such arrangements for assemblable wall constructions have been disclosed, for example, in Reeves U.S. Pat. Nos. 3,591,993; Mote 3,124,222 and Robinson, et al. 1,998,688.

Insofar as I am aware or have been able to ascertain from construction industry practices, none of the foregoing have shown up to achieve widespread or common usage to replace the aforementioned conventional concrete block or stud and wallboard constructions. While I can only speculate as to the reasons for such arrangements having failed to gain any noticable acceptance, it may be due to such factors as costs of the components, complexities or skill required in assembly and lack of any real ease to dissemble for a true temporary construction with salvageable components.

SUMMARY OF THE INVENTION

The general aim of the present invention is to provide a new and improved temporary wall panel system which is relatively low in cost, easy to assemble and install, yet permits relative ease of disassembly for removal or relocation.

Another object of the invention is to provide a fairly low cost temporary partition wall system of the foregoing type wherein relatively simple and versatile components may be assembled with a maximum of flexibility and sturdiness when assembled.

These and other advantages of the invention will become more apparent from the following detailed description when taken in conjunction with the accompanying drawings.

DETAILED DESCRIPTION OF THE PREFERRED EMBODIMENT

Figure 1:
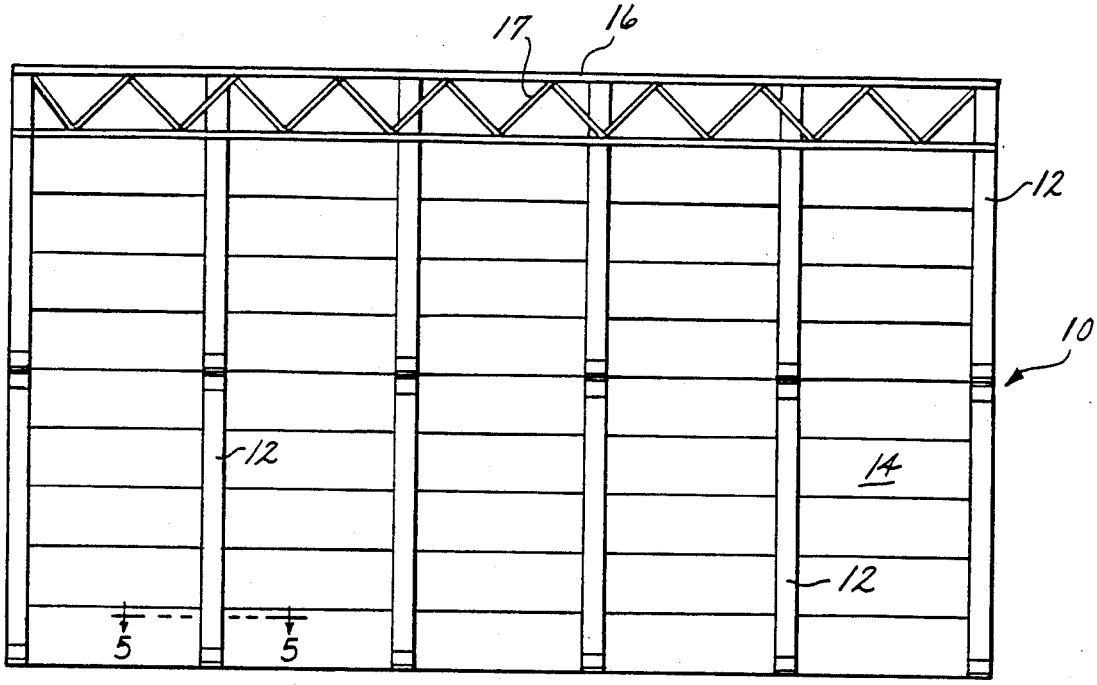
FIG. 1 is a front elevational view of a wall unit construction in accordance with the present invention.

Turning to the drawings, there is illustrated in FIG. 1, a wall construction of the present invention indicated generally at 10, which is made up of spaced vertical steel H-beams 12 forming columns that receive a stacking of preformed concrete panels 14.

Figure 2:
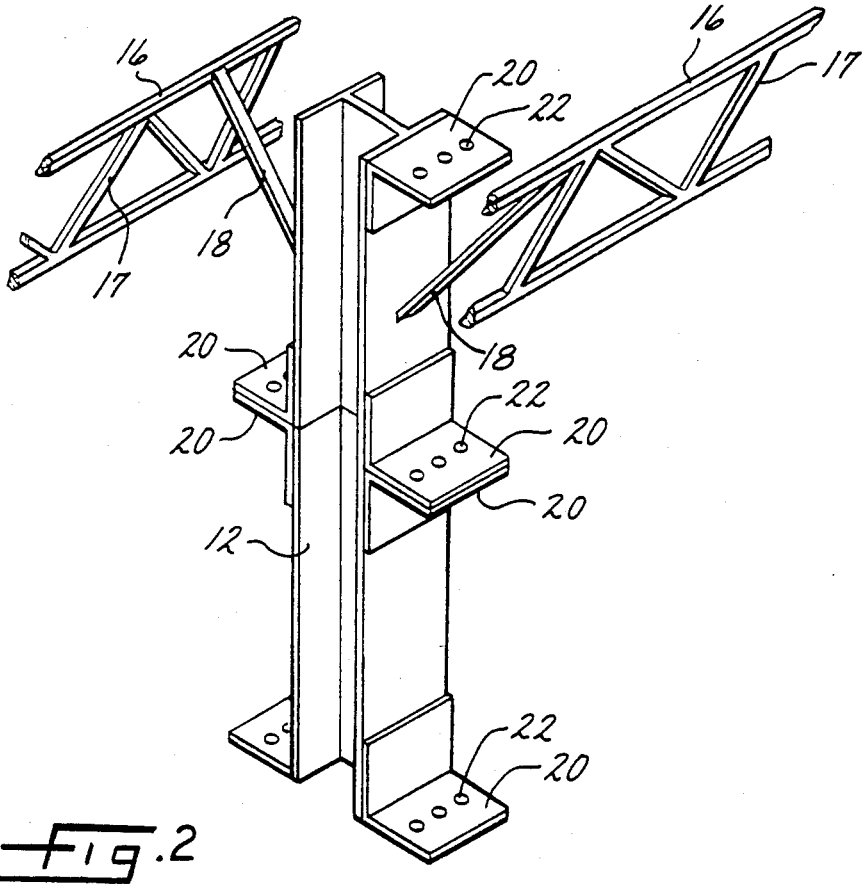
FIG. 2 is a fragmentary perspective view showing a upright beam column of the present invention positioned between a typical pair of building bar joists.

As shown in FIG. 1, the wall construction is positioned running parallel to a conventional building bar joist 16 as typically present in industrial buildings. Such bar joists are fabricated elements comprising parallel spaced metal bar members which are interconnected by angled bar members 17 which appear as a triangular geometric pattern. When the wall 10 of the present invention is to be constructed alongside one of such bar joists, the vertical beams or columns 12 can be connected directly to the joist (not shown) or as illustrated in FIG. 2, bracing elements 18 can be used to span between the column and joist 16.

In accordance with the present invention, it is preferred that the H-beams 12 that make up the vertical columns are provided in shorter sections with the sections being further provided with angle brackets 20 welded or otherwise affixed adjacent their ends. The outwardly projecting leg of the angle brackets 20 have holes 22 which can receive bolts or other fasteners (not shown) to secure adjoining brackets together or mount a column to a floor or ceiling. It will be appreciated that the segmented and assemblable beam section arrangement permits accommodating different heights of ceilings as well as allowing the beams to be more easily handled by personnel.

Figure 3:
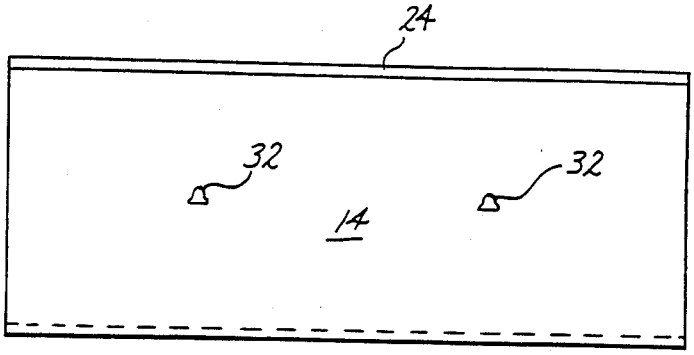
FIG. 3 is a side view of a preformed concrete panel of the present invention.
Figure 4:
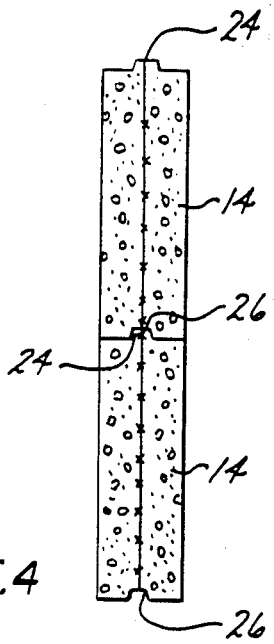
FIG. 4 is an end view of two of the panels of FIG. 3, stacked one on top the other.

In accordance with another aspect of the present invention, referring to FIGS. 3 and 4, the panels are preformed wire reinforced concrete and are generally rectangular in shape. The panels of my preferred embodiment are approximately 2 feet high by 6 feet long and 3 or 4 inches wide. While other panel sizes or shapes may be provided for a system package, the present panels can be readily cut with a concrete saw for completion of wall ends or at the tops of walls of lesser dimensions than the full panels.

In order to permit more secure and steady stacking of the panels, each panel at its uppper end has a longitudinally extending tongue 24 and a longitudinally extending groove 26 at its lower end. It should be appreciated by those skilled in the art, that other interengaging configurations besides the tongue and groove can be utilized if so desired. For example, one end of a panel can be concave while the other end is convex such as shown in the aforementioned Wiebusch patent which would provide a self-centering and also prevents transverse slippage between the stacked panels 14.

Figure 5:
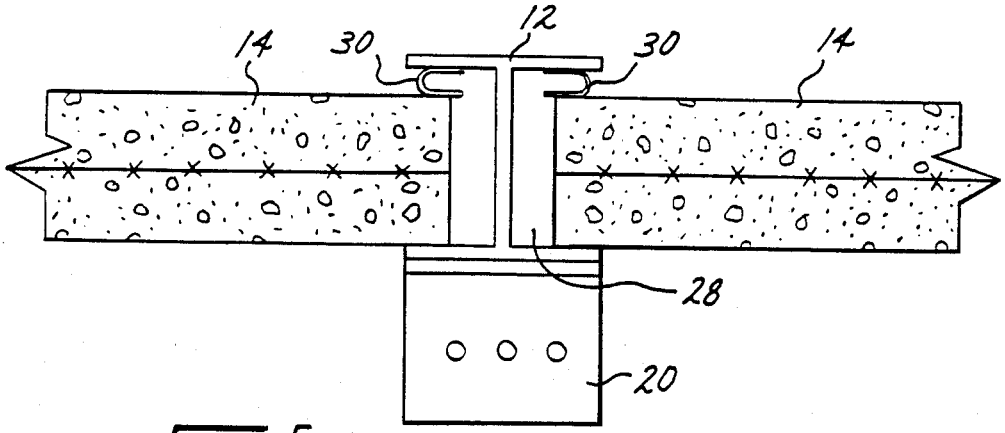
FIG. 5 is a fragmentary section taken substantially along the line 5—5 in FIG. 1.

In accordance with yet another one of the important aspects of the present invention, the H-beam vertical columns 12 are set up and spaced in such a manner that the panels can be inserted horizontally and then centered between a pair of beams bridging the beams, but yet having a space 28 like that shown in FIG. 5 between the end of the panels and the beams 12. Thus, the center-to-center distance and placement of the vertical beams 12 should be longer than the panel length by an amount which will permit a panel to be inserted between the H-shaped legs of a beam 12 at one side butted in against the one beam and then when the panel is aligned with the spaced beam at the opposite side of the panel, the panel can then be slid over until it is held between the two spaced beams.

Figure 6:
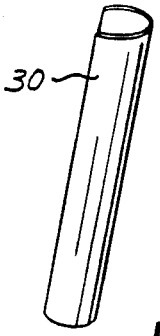
FIG. 6 is a perspective of one of the wedging fillers of the present invention for holding the stacked panels together with the beams.

In accordance with another aspect of the present invention, there is provided a wedging filler member 30 (FIG. 5) which can be forceably inserted between the panels and the beam flanges to complete the rigid holding of the stacked panels in place. The wedge like filler member 30, as shown in FIG. 6, is a preselected length of U-shaped sheet metal or the like having a sufficient spring like action that provides a firm holding when inserted as illustrated in FIG. 5. In addition to providing the holding which sturdies up the wall during and when assembled, the filler also acts as a seal which will provide appropriate "fireproofing" of a wall constructed in accordance with the present invention. The length of the filler element 30 is preferably about the same as the height of one panel, although longer filler elements can be provided to accomplish securing of multiple panels at one time after they have been laid in place.

It should be appreciated that with the wedge like filler 30 arrangement, the new type of wall construction can be put up and taken down very quickly. Since the fillers can be pushed all the way inwardly toward the beam centers to release them and even if the fillers are not later salvageable for later use, they are sufficiently low in cost that new fillers can be obtained with the same columns and panels being readily reuseable. For ease of handling the panels, particularly when lifting the same, cavity like inserts 32 are preformed in the side walls of the panel 14, as shown in FIG. 3.

I claim as my invention:

1. An assemblable temporary wall unit construction comprising at least a pair of horizontally spaced vertical H-beam members forming columns, a plurality of preformed stackable panels positionable between and bridging said beam columns, the spacing between said beam columns being such that the panels can be inserted horizontally by positioning one end of the panel adjacent one of said beam columns, aligning the panel with the other beam column and shifting said panel horizontally to bridge the spaced columns, and wedge like filler members being removably insertable and accessibly located between the panels and beam columns for rigidly holding and confining the panels in a removable manner with respect to said beam columns in order to permit easy assembly and disassembly of said wall construction.

2. A wall unit construction as claimed in claim 1 wherein said column forming beams are segmented and attachable together to form the vertical columns.

3. A wall panel construction as claimed in claim 2 wherein said beam segments have angle flanges at opposite ends for fastener attachement together and to a floor and ceiling.

4. A wall unit construction as claimed in claim 1 wherein said filler members are generally U-shaped metal elements.

5. A wall unit construction as claimed in claim 1 wherein said panels are reinforced concrete.

6. A wall construction as claimed in claim 5 wherein said panels have interengaging shapes at top and bottom opposite ends thereof.

7. A wall unit construction as claimed in claim 6 wherein said panels intergaging shapes are a tongue and groove.

* * * * *